US010870148B2

(12) United States Patent
Bishop et al.

(10) Patent No.: US 10,870,148 B2
(45) Date of Patent: Dec. 22, 2020

(54) ALUMINUM ALLOY POWDER METAL WITH TRANSITION ELEMENTS

(75) Inventors: Donald Paul Bishop, Stillwater Lake (CA); Richard L. Hexemer, Jr., Granite Falls, NC (US); Ian W. Donaldson, Jefferson, MA (US); Randy William Cooke, Halifax (CA)

(73) Assignee: GKN Sinter Metals, LLC, Auburn Hills, MI (US)

( * ) Notice: Subject to any disclaimer, the term of this patent is extended or adjusted under 35 U.S.C. 154(b) by 554 days.

(21) Appl. No.: 13/993,942

(22) PCT Filed: Dec. 14, 2011

(86) PCT No.: PCT/US2011/064875

§ 371 (c)(1),
(2), (4) Date: Aug. 7, 2013

(87) PCT Pub. No.: WO2012/082877

PCT Pub. Date: Jun. 21, 2012

(65) Prior Publication Data

US 2013/0309123 A1 Nov. 21, 2013

Related U.S. Application Data

(60) Provisional application No. 61/423,535, filed on Dec. 15, 2010, provisional application No. 61/477,764, filed on Apr. 21, 2011.

(51) Int. Cl.
*B22F 1/00* (2006.01)
*B22F 9/08* (2006.01)
(Continued)

(52) U.S. Cl.
CPC ..... *B22F 1/0003* (2013.01); *B22F 9/082* (2013.01); *C22C 1/0416* (2013.01); *C22C 32/0047* (2013.01); *B22F 2998/10* (2013.01)

(58) Field of Classification Search
CPC .. C22C 32/0047; C22C 1/0416; B22F 1/0003
See application file for complete search history.

(56) References Cited

U.S. PATENT DOCUMENTS 3,637,441 A 1/1972 Lyle, Jr. et al.
4,177,069 A 12/1979 Kobayashi et al.
(Continued)

FOREIGN PATENT DOCUMENTS

JP S63312901 A 12/1988
JP H06057363 A 3/1994
(Continued)

OTHER PUBLICATIONS

The State Intellectual Property Office of the People's Republic of China, Second Office Action, Application No. 201180056037.0, dated Apr. 7, 2015, 18 pages.
(Continued)

*Primary Examiner* — Colleen P Dunn
*Assistant Examiner* — Jeremy C Jones
(74) *Attorney, Agent, or Firm* — Quarles & Brady LLP

(57) ABSTRACT

A transition element-doped aluminum powder metal and a method of making this powder metal are disclosed. The method of making includes forming an aluminum-transition element melt in which a transition element content of the aluminum-transition element melt is less than 6 percent by weight. The aluminum-transition element melt then powderized to form a transition element-doped aluminum powder metal. The powderization may occur by, for example, air atomization.

9 Claims, 5 Drawing Sheets

(51) Int. Cl.
*C22C 1/04* (2006.01)
*C22C 32/00* (2006.01)

(56) References Cited

U.S. PATENT DOCUMENTS

| | | | | | |
|---|---|---|---|---|---|
| 4,801,412 | A | | 1/1989 | Miller | |
| 5,176,740 | A | * | 1/1993 | Miura | C22C 21/00 420/529 |
| 5,356,453 | A | | 10/1994 | Takata | |
| 5,372,775 | A | * | 12/1994 | Hayashi | C22C 32/00 419/10 |
| 5,460,775 | A | * | 10/1995 | Hayashi | B22F 3/1007 419/10 |
| 5,478,418 | A | | 12/1995 | Miura et al. | |
| 5,561,829 | A | * | 10/1996 | Sawtell | C22C 1/05 419/13 |
| 5,693,897 | A | | 12/1997 | Kita | |
| 6,468,468 | B1 | | 10/2002 | Neubing et al. | |
| 8,920,533 | B2 | * | 12/2014 | Bishop | B22F 3/24 75/249 |
| 2005/0034559 | A1 | * | 2/2005 | Lindenau | B22F 1/0003 75/249 |
| 2005/0036899 | A1 | * | 2/2005 | Lindenau | B22F 3/12 419/38 |
| 2010/0254850 | A1 | * | 10/2010 | Pandey | C22C 1/0416 420/529 |

FOREIGN PATENT DOCUMENTS

| | | | |
|---|---|---|---|
| JP | H06316702 | A | 11/1994 |
| JP | H07278714 | A | 10/1995 |

OTHER PUBLICATIONS

Canadian Intellectual Property Office, Office Action, Application No. 2,817,590, dated May 2, 2014, 3 pages.
The State Intellectual Property Office of the People's Republic of China, First Office Action and Search Report, Application No. 201180056037.0, dated Jul. 23, 2014, 20 pages.
International Search Report and Written Opinion dated Apr. 13, 2012 in connection with PCT/US2011/064875.
Canadian Intellectual Property Office, Examination Report, Application No. 2,817,590, dated Feb. 26, 2015.
Japan Patent Office, Notification of Reasons for Refusal, Application No. 2013-544738, dated Jan. 6, 2015.
Canadian Intellecutal Property Office, Examination Report, Application No. 2,817,590, dated Nov. 6, 2015.
The State Intellectual Property Office of the People's Republic of China, Third Office Action, Application No. 201180056037, dated Sep. 18, 2015.
The State Intellectual Property Office of the People's Republic of China, Decision on Rejection, Application No. 201180056037, dated Dec. 28, 2015.
Japan Patent Office, Decision of Refusal, Application No. 2013-544738, dated Oct. 13, 2015.
The State Intellectual Property Office of the People's Republic of China, Notice on Reexamination, Application No. 201180056037, dated Aug. 8, 2016.
Canadian Intellectual Property Office, Office Action for corresponding Application No. 2,817,590, dated Mar. 14, 2017, 4 pages.
Japanese Patent Office, Notice of Allowance and Allowed Claims for corresponding Japanese Application No. 2013-544738, claims in English, dated May 24, 2016, 4 pages.
The State Intellectual Property Office of the People's Republic of China, Notice on Reexamination for corresponding Chinese Application No. 201180056037.0 with English translation, dated Dec. 21, 2016, 8 pages.
The State Intellectual Property Office of the People's Republic of China, Decision on Reexamination for corresponding Chinese Application No. 201180056037.0, dated Jun. 29, 2017, 9 pages.
Canadian Intellectual Property Office, Office Action for corresponding Canadian Application No. 2,817,590, dated Mar. 20, 2018, 3 pages.
China National Intellectual Property Administration, Decision on Rejection, Appication No. 201710882224.3, dated May 27, 2020, 15 pages. With translation.

* cited by examiner

ALUMINUM ALLOY POWDER METAL WITH TRANSITION ELEMENTS

CROSS-REFERENCE TO RELATED APPLICATIONS

This application represents the national stage entry of PCT International Application No. PCT/US2011/064875 filed Dec. 14,2011,and claims the benefit of U.S. provisional patent application Ser. No. 61/423,535 filed on Dec. 15, 2010 and U.S. provisional patent application Ser. No. 61/477,764 filed on Apr. 21, 2011. The disclosure of each of these applications is incorporated by reference for all purposes as if set forth in their entirety herein.

STATEMENT OF FEDERALLY SPONSORED RESEARCH OR DEVELOPMENT

Not applicable.

BACKGROUND OF THE INVENTION

This disclosure relates to powder metallurgy. In particular, this disclosure relates to powder metal formulations for powder metallurgy.

Powder metallurgy is an alternative to more traditional metal forming techniques such as casting. Using powder metallurgy, parts with complex geometries may be fabricated that have dimensions very close to those dimensions desired in the final part. This dimensional accuracy can save significant expense in machining or reworking, particularly for parts having large production volumes.

Parts made by powder metallurgy are typically formed in the following way. First, a formulation including one or more powder metals and a lubricant material is compacted in a tool and die set under pressure to form a PM compact. This PM compact is then heated to remove the lubricant material and to sinter the individual particles of the powder metal together by diffusion-based mass transport. Sintering is typically performed by heating the powder metal material to a temperature that is either slightly below or above its solidus temperature. When held below the solidus temperature, sintering occurs in the absence of a liquid phase. This is commonly referred to as solid state sintering. When held above the solidus temperature, a controlled fraction of a liquid phase is formed. Sintering in this manner is known as liquid phase sintering. Regardless of the sintering temperature employed, the sintered part is very similar in shape to the original compact.

During the sintering process, it is common for the parts to shrink dimensionally. As diffusion occurs, adjacent particles will neck into one another to form permanent bonds with one another and to begin to fill any voids between the particles. This densification closes and/or decreases the size of the pores and decreases the overall size of the sintered part in comparison to the compact. Even at long sintering times, however, some voids will remain in the sintered part. Unfortunately, for sintered parts that are less than fully dense, the mechanical strength of those sintered parts are also usually somewhat less than that of a wrought part.

Hence, a need exists for improved powder metals. In particular, there has been a continued need for powder metals that, when sintered, have mechanical strength approaching that of their wrought counterparts.

SUMMARY OF THE INVENTION

An improved aluminum alloy powder metal and a related method of making the powder metal are disclosed. PM parts made from the disclosed aluminum alloy powder metal have improved strength properties in comparison to those having traditional aluminum powder metal compositions and microstructures. The aluminum alloy powder metal has improved strength properties, at least in part, because the transition elements are doped the aluminum powder metal in a relatively homogenous fashion throughout the powder metal. This decreases the amount of intermetallics formed along the grain boundaries where these intermetallics are of limited benefit and promotes the formation of strengthening dispersoid phases homogenously throughout the sintered part. A morphology of this type is unknown in press-and-sinter type products.

A method of making a powder metal for production of a powder metal part is disclosed. The method includes forming an aluminum-transition element melt in which a content of a transition element of the aluminum-transition element melt is less than 6 percent by weight of the melt. The aluminum-transition element melt is powderized to form a transition element-doped aluminum powder metal. The transition element addition(s) may include one or more of iron, nickel, titanium, and manganese.

In one form of the method, the step of powderizing may include air atomizing the aluminum-transition element melt. In other forms of the method, powderizing the aluminum-transition element melt to form a transition element-doped aluminum powder metal may include atomizing with gases other than air (such as, for example, nitrogen, argon, or helium), comminution, grinding, chemical reaction, and/or electrolytic deposition.

A powder metal part may be formed from this transition element-doped aluminum powder metal. A concentration of the transition element in the powder metal part may be substantially equal to a concentration of the transition element found in the transition element-doped aluminum powder metal used to form the powder metal part, meaning that little or none of the transition element is added as a separate elemental powder or as part of a master alloy. The powder metal part formed from the transition element-doped aluminum powder metal may have substantially fewer intermetallics formed along grain boundaries of the part in comparison to a powder metal part made from a powder metal of similar composition but with the transition element added as an elemental powder or as part of a master alloy.

The transition element-doped aluminum powder metal may be mixed with other powder metals to provide at least one other alloying element. By mixing the transition element-doped aluminum powder metal with another powder metal, a mixed powder metal is formed which then can be used to form the powder metal part.

A powder metal made by the above-stated methods is also disclosed. The powder metal is a transition element-doped aluminum powder metal in which the transition element is homogenously dispersed throughout the transition metal-doped aluminum powder metal and, further, in which the transition metal-doped aluminum powder metal contains less than 6 weight percent of the transition element(s).

Additionally, the transition element-doped aluminum powder metal may be formed by air atomization or by the other forms of powderization described herein.

The transition element may include one or more of iron, nickel, manganese, and titanium. Ceramic additives such as, for example, SiC and/or AlN may also be added in amounts of up to 15 volume percent.

Another method of making a powder metal for production of a powder metal part is also disclosed. The method includes forming an aluminum-alloying element melt in which a content of the alloying element(s) in the aluminum-alloying element melt is less than 6 percent by weight. The alloying element(s) are selected from the group consisting of iron, nickel, titanium, and manganese. The aluminum-alloying element melt is powderized to form an alloying element-doped aluminum powder metal.

Still another method of making a powder metal for production of a powder metal part is disclosed. According to this method, an aluminum-alloying element melt is formed in which a content of an alloying element in the aluminum-alloying element melt is less than 6 percent by weight. The aluminum-alloying element melt is powderized to form an alloying element-doped aluminum powder metal. The alloying element forms an intermetallic phase with the aluminum and this intermetallic phase is homogenously dispersed throughout alloying element-doped aluminum powder metal. Among other things, the intermetallic improves the strength of a part made from this powder metal because the intermetallic phase is not primarily located at the grain boundaries as in conventional PM materials.

These and still other advantages of the invention will be apparent from the detailed description and drawings. What follows is merely a description of some preferred embodiments of the present invention. To assess the full scope of the invention, the claims should be looked to as these preferred embodiments are not intended to be the only embodiments within the scope of the claims.

DETAILED DESCRIPTION OF THE PREFERRED EMBODIMENTS

Figure 1:
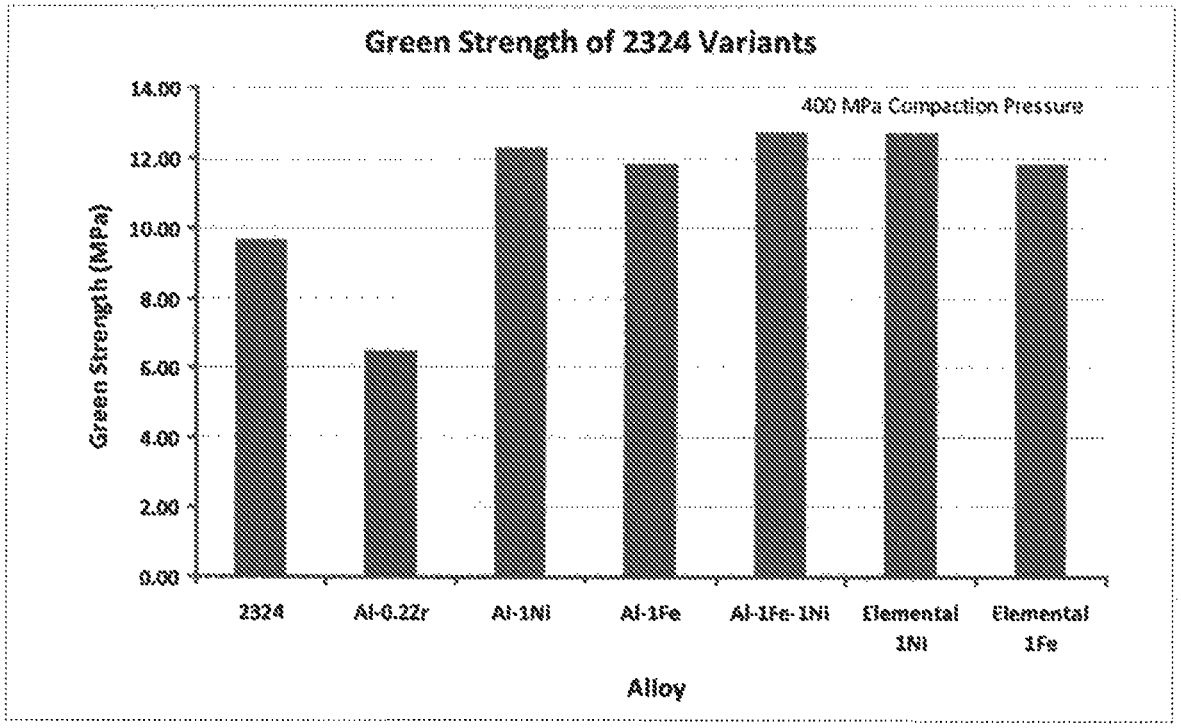
FIG. 1 is a chart showing the green strength of various powder variants of a 2324 aluminum alloy (Al-4.5Cu-1.5Mg-0.2Sn)

A number of powder metal samples were produced having various chemistries for comparison purposes. As a baseline system for comparison, a 2324 aluminum alloy powder metal was used (the alloy number corresponds to an alloy name under the International Alloy Designation System). The 2324 aluminum alloy used as a baseline includes 4.5 weight percent copper, 1.5 weight percent magnesium, and 0.2 weight percent tin with the remainder of the powder being aluminum (any other impurities being found in minimal amounts). The blend also uses a 1.5 weight percent Licowax C as the lubricant. The Licowax C is a lubricant material and boils off during heating.

Variants of the 2324 aluminum alloy were also prepared with the addition of transition elements including iron and nickel. These transition elements were added either as a prealloyed constituent by air atomization or as an elemental powder in different prepared samples.

Notably, the variant powder blends are a transition element-doped aluminum powder with up to 6 wt % of the transition element. Conventionally, when alloying elements are added to a powder blend, these alloying elements are added either as an elemental powder (i.e., a pure powder containing only the alloying element) or as a master alloy containing a large amount of both the base material, which in this case is aluminum, and the alloying element (e.g., a 50/50 master alloy). When a master alloy is used, to obtain the desired amount of the alloying element in the final part, the master alloy will then be "cut" with an elemental powder of the base material.

In contrast, the transition element-doped aluminum powder metal is obtained by air or gas atomizing an aluminum-transition element melt containing the desired final composition of the transition element or elements. Air atomizing the powder becomes problematic at higher transition element concentrations and so it may not be possible to atomize transition element-doped powders having high weight percentages of the transition elements (believed at this time to exceed 6 weight percent).

The addition of transition elements results in the formation of intermetallics that strengthen the alloy and that remain stable over a range of temperatures. If the transition elements were added as an elemental powder or as part of a master alloy as has been traditionally performed, then the intermetallic phase would be formed preferentially along the grain boundaries and would be coarse in size since relatively slow diffusion kinetics and chemical solubility prevent transition elements from being uniformly distributed within the sintered microstructure. Under those conditions, the intermetallic phase imparts only limited improvement in the properties of the final part.

By doping the transition element(s) in the aluminum powder, rather than adding the transition element(s) in the form of an elemental powder or as part of a master alloy, the transition element(s) are more evenly and homogeneously dispersed throughout the entire powder metal. Thus, the final morphology of the transition element-doped part will have the transition element(s) placed throughout the aluminum and the intermetallics will not be relegated or restricted to placement primarily along the grain boundaries at which they are of only limited effectiveness.

It should be appreciated that while the samples prepared include transition element additions of iron and/or nickel, that other transition elements could also be used. For example, manganese and titantium could additionally be added as doped prealloyed transition elements.

To compare the various powder metals, the 2324 and variant powders were made into test bars. Each of the powders were compacted into test bar samples, sintered, and then given either a T1 or T6 heat treatment.

Looking first at FIG. 1, the green strength of various powder compositions are compared to one another. Among the samples prepared and tested were the 2324 aluminum alloy and the 2324 aluminum alloy with 0.2 wt % zirconium prealloyed by air atomization, with 1 wt % nickel prealloyed by air atomization, with 1 wt % iron prealloyed by air atomization, with 1 wt % iron and 1 wt % nickel prealloyed by air atomization, with 1 wt % nickel added as an elemental powder, and with 1 wt % iron added as an elemental powder. All of these samples were compacted at 400 MPa compaction pressure.

From an examination of FIG. 1, it can be seen that the addition of 1 wt % iron and/or 1 wt % nickel will result in an appreciable increase in the green strength of the samples. This is the case whether the iron and/or nickel are added through air atomization or as an elemental powder addition. The 2324 aluminum alloy has a green strength of just under 10 MPa, whereas the samples containing iron and/or nickel have green strengths of approximately 12 MPa or greater.

Figure 2:
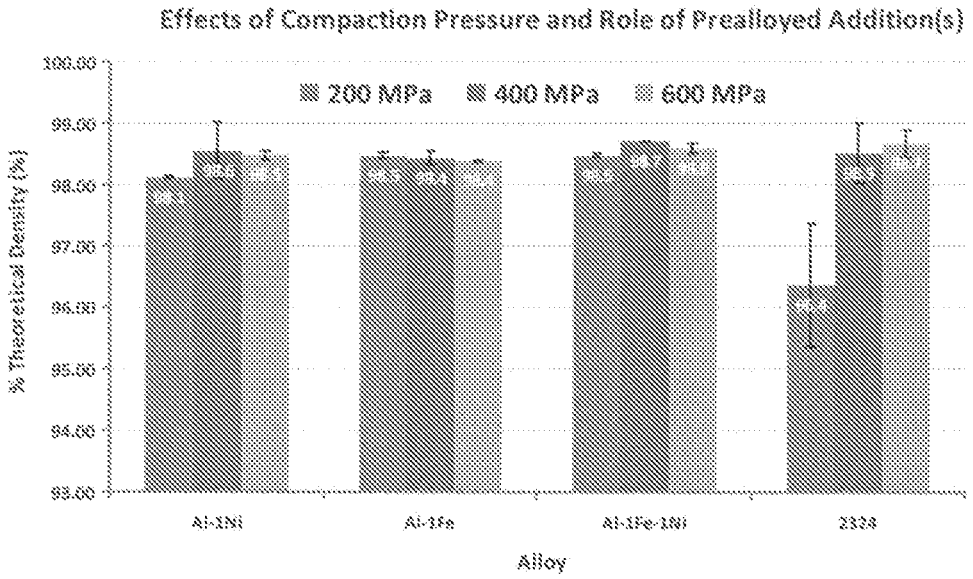
FIG. 2 is a chart showing the percent of theoretical density obtained at various compaction pressures for powders of a 2324 aluminum alloy and variants thereof.

FIG. 2 illustrates the effect of compaction pressure and prealloyed additions on sintered density. Four sample compositions are compared including the 2324 aluminum alloy with 1 wt % nickel prealloyed by air atomization, with 1 wt % iron prealloyed by air atomization, with 1 wt % iron and 1 wt % nickel prealloyed by air atomization, and the 2324 base aluminum alloy alone. Samples of each of these compositions were prepared at compaction pressures of 200 MPa, 400 MPa, and 600 MPa and then sintered.

The average percent of theoretical density for each of these compositions at the various compaction pressures is shown in FIG. 2, as well as the observed range of percent of theoretical density. As can be seen from an examination of the collected data, the prealloyed compositions all have average percent theoretical densities of 98% or above for all of the compaction pressures. In comparison, the percent theoretical density for the 2324 aluminum alloy without any prealloyed nickel or iron at 200 MPa compaction pressure is only 96.4%. Moreover, an examination of the prealloyed compositions indicates that the addition of the transition elements reduces the range around the average percent theoretical density. This indicates that the compositions prealloyed with transition elements more reliably obtain a sintered density around the average percent theoretical density.

Figure 3:
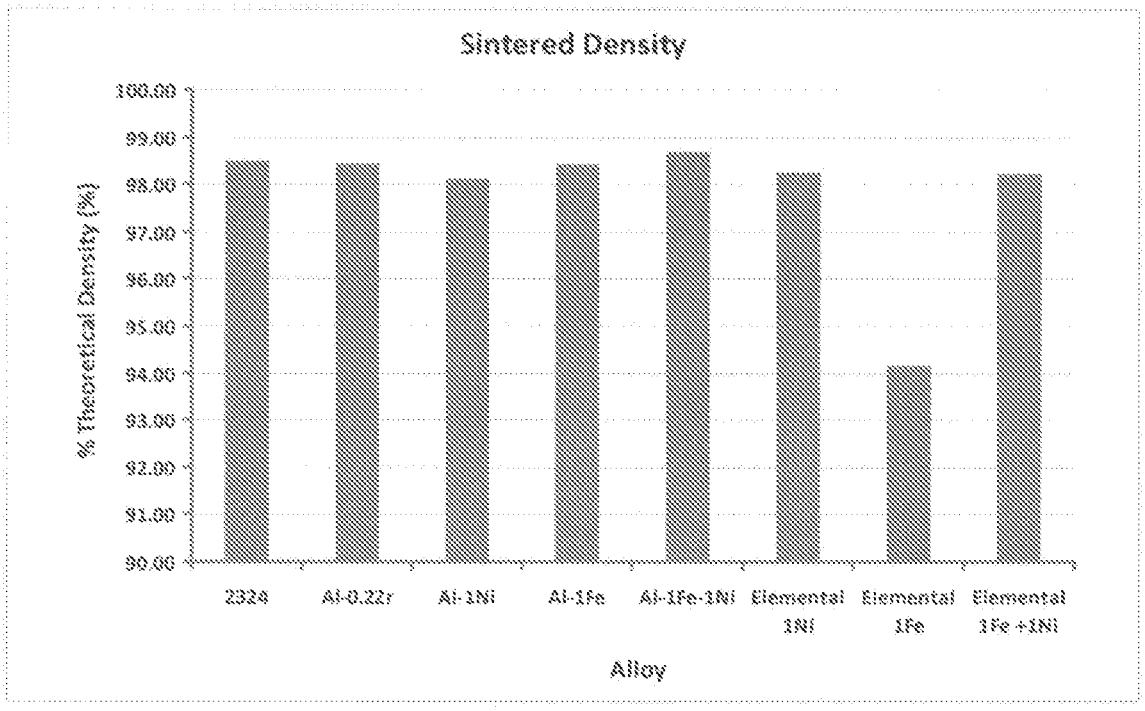
FIG. 3 is a chart showing the percent of theoretical density obtained for samples sintered from the 2423 aluminum alloy powder metal and a number of variants thereof.

Turning now to FIG. 3, the percent of theoretical density obtained of the various samples (i.e., 2324 aluminum alloy base powder, 2324 with prealloyed air atomized transition elements, and 2343 with elemental powder additions of transition elements) are compared to one another. Most notably, FIG. 3 reveals that while the addition of 1 wt % iron as an elemental powder degrades sintering, prealloying the same amount of iron by air atomization does not. The samples having 1 wt % iron added as an elemental powder only reach 94% of theoretical density. In contrast, the samples with 1 wt % iron prealloyed via air atomization reach a theoretical density of just below 98.5%.

Figure 4:
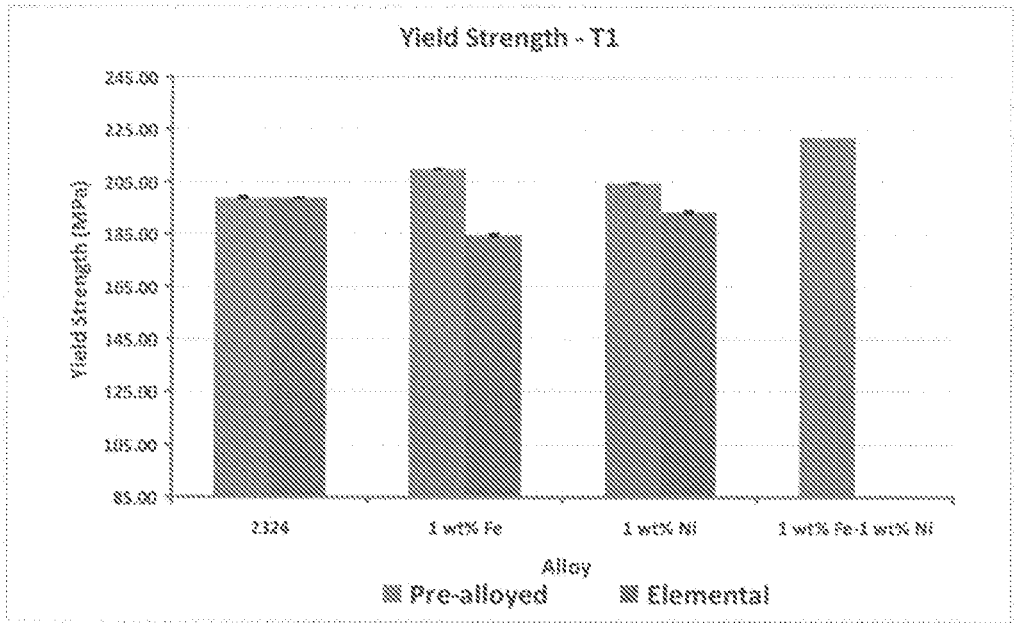
FIGS. 4 through 7 are graphs comparing the yield strength, ultimate tensile strength (UTS), percent elongation, and Young's modulus of samples made from the aluminum alloy powder metals subjected to a T1 heat treatment, including in some instances the differences between the prealloyed and elemental addition of the transition elements to the aluminum alloy powder metal.
Figure 5:
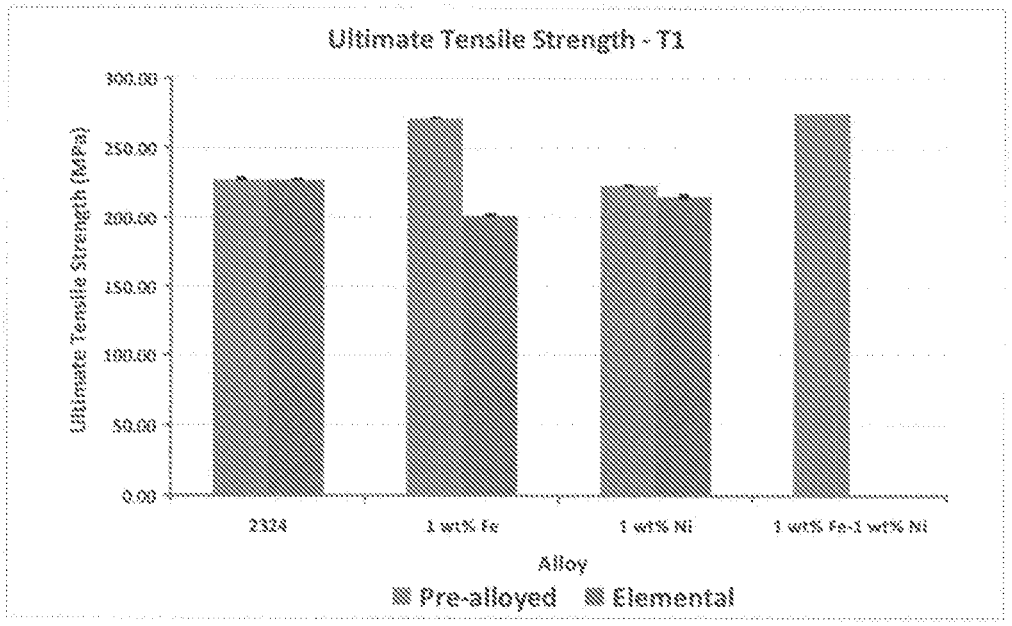
Figure 6:
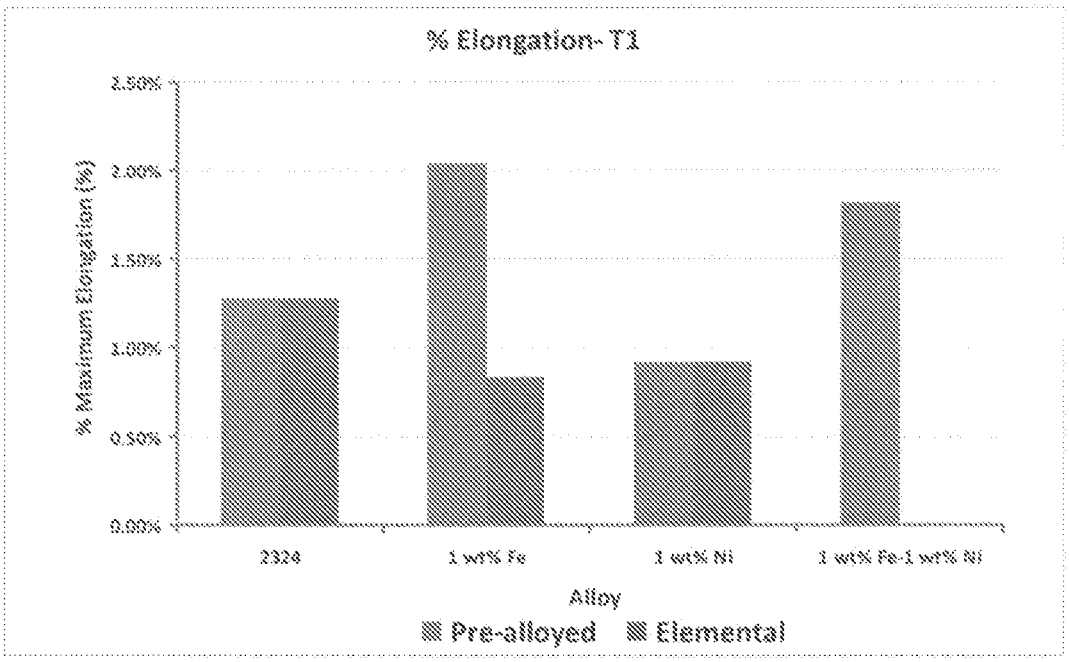
Figure 7:
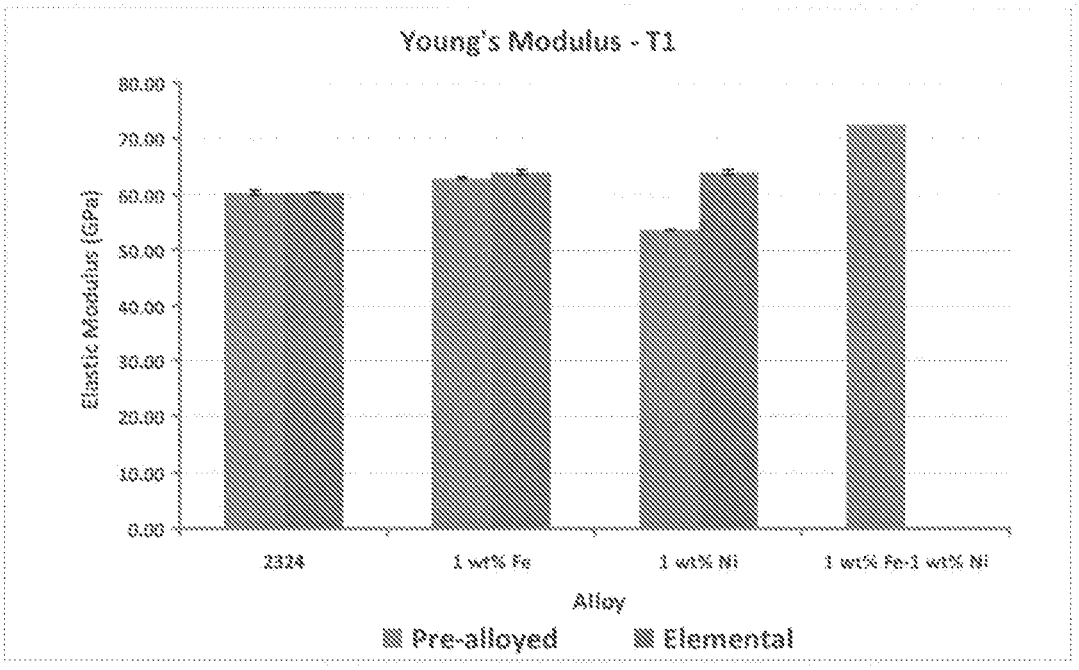

Looking now at FIGS. 4 though 7, the mechanical properties of samples made from the 2324 base aluminum alloy powder metal and some of the variants thereof are compared after sintering and T1 heat treatment. Specifically, comparison is made between the 2324 aluminum alloy, the 2324 aluminum alloy with 1 wt % iron (both prealloyed by air atomization and added as an elemental powder), the 2324 aluminum alloy with 1 wt % nickel (both prealloyed by air atomization and added as an elemental powder), and the 2324 aluminum alloy with 1 wt % iron and 1 wt % nickel prealloyed by air atomization.

The tensile properties of the prealloyed T1 heat treated samples are generally better than, or at least comparable with, both the 2324 aluminum alloy base composition and the compositions in which the transition elements are added in the form of elemental powder. In particular, the 1 wt % iron and 1 wt % nickel prealloyed samples have tensile properties (including yield strength, ultimate tensile strength, elongation, and Young's modulus) which are greater than the 2324 base material samples, the 1 wt % iron samples (made by air atomization or added as elemental powder), and the 1 wt % nickel samples (made by air atomization or added as elemental powder). The only instance in which the 1 wt % iron and 1 wt % nickel sample underperforms the other samples is in elongation in which the 1 wt % iron air atomized sample has slightly greater elongation before fracture. Parts made from the 1 wt % iron and 1 wt % nickel air atomized powder metal have average yield strengths of approximately 220 MPa, ultimate tensile strengths of approximately 275 MPa, percent elongations of just over 1.75 percent, and a Young's modulus exceeding 70 GPa.

Figure 8:
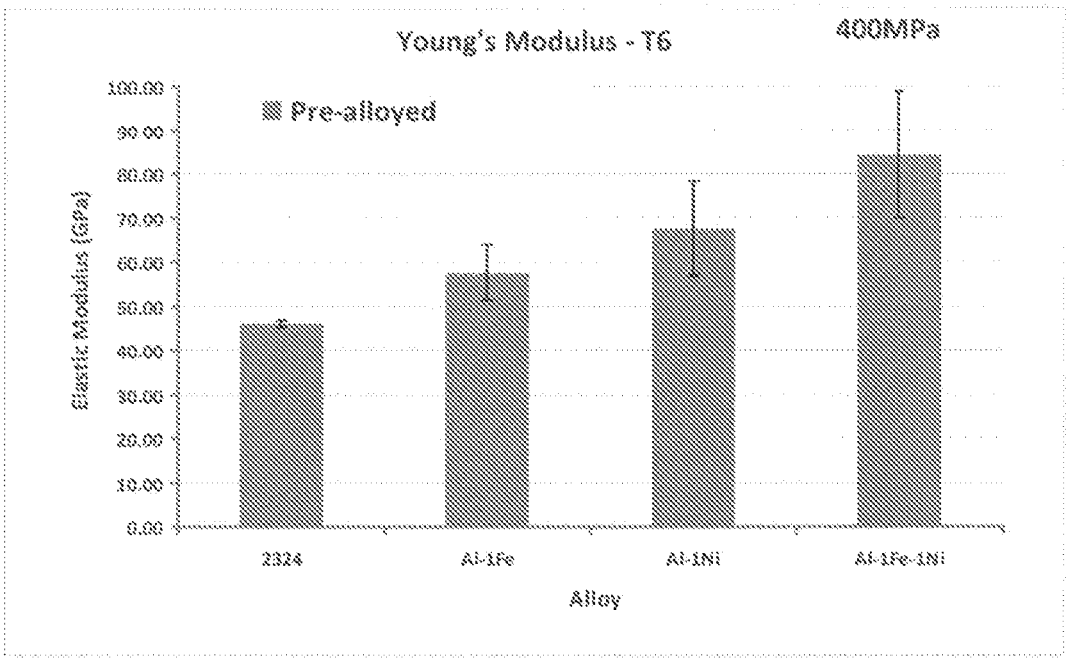
FIGS. 8 and 9 are graphs comparing the Young's modulus and the yield strength of samples made from the aluminum alloy powder metals subjected to a T6 heat treatment.
Figure 9:
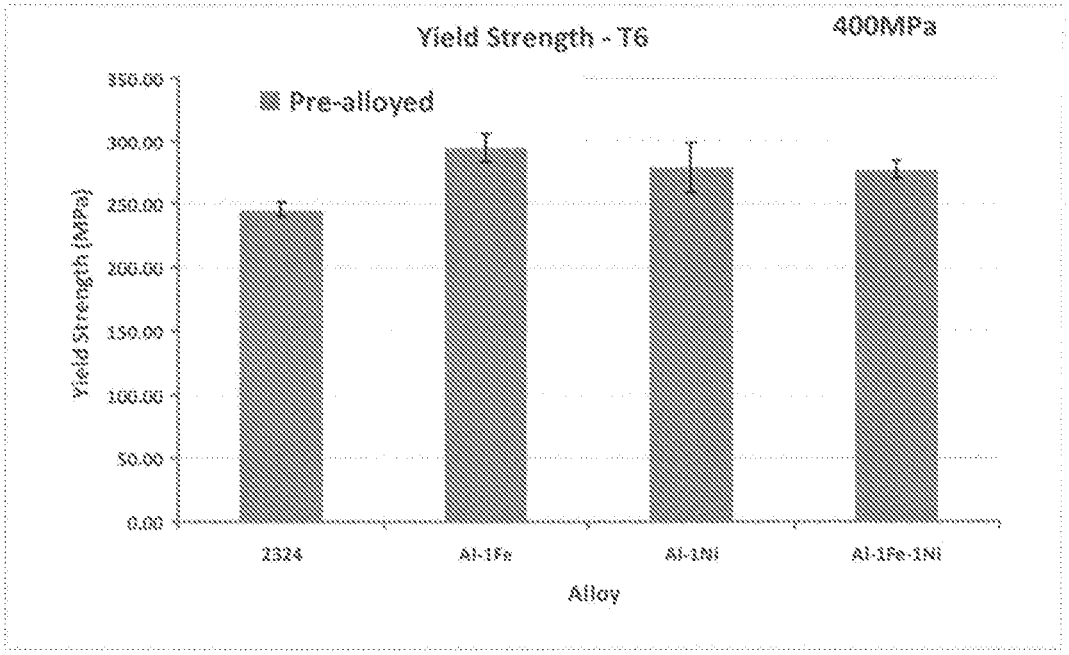

Turing now to FIGS. 8 and 9, the Young's modulus and yield strength of the 2324 base alloy material and various compositions containing transition elements prealloyed by air atomization are compared for samples compacted at 400 MPa and subjected to a T6 heat treatment. Again, the prealloyed addition of 1 wt % iron and/or 1 wt % nickel by air atomization results in a greater observed Young's modulus and greater observed yield strengths than the 2324 base powder without these additions. The most impressive difference is seen in FIG. 8 in which an average Young's modulus for the 2324 base aluminum alloy is approximately 45 GPa, whereas an average Young's modulus for the 2324 aluminum alloy with 1 wt % iron and 1 wt % nickel is approximately 85 GPa.

Although 2324 aluminum alloy powder metal base was utilized in preparation of the samples prepared and tested above, it will be appreciated that other aluminum alloy systems could have transition elements prealloyed therewith. These aluminum alloy systems include, but are not limited to, Al—Cu—Mg—Si (e.g., Al-4.5Cu-0.5Mg-0.7Si), Al—Zn—Mg—Cu (e.g., Al-5.5Zn-2.5Mg-1.5Cu), Al—Mg—Sn, and Al—Cu—Mg—Sn (e.g., Al-2.3Cu-1.6Mg-0.2Sn).

Additional comparative data for the Al-2.3Cu-1.6Mg-0.2Sn aluminum alloy system is now provided as an example to further support the benefits of prealloying nickel and iron in an aluminum powder metal.

Sintered powder metal samples were prepared from the Al-2.3Cu-1.6Mg-0.2Sn aluminum alloy powder metal, this powder metal formulation prealloyed with 1 wt % iron, this powder metal formulation with 1 wt % iron added as an elemental powder addition, this powder metal formulation prealloyed with 1 wt % nickel, and this powder metal formulation with 1 wt % nickel added as an elemental powder addition.

The alloys with prealloyed 1 wt % iron and with 1 wt % nickel exhibited essentially identical compressibility curves with a maximum density of 96.3% of theoretical attained in both cases. In comparison, identical peak values were observed in the blends that incorporated 1 wt % iron and nickel as elemental powders. As such, prealloyed additions did not impede the compressibility of the base alloy.

The two green strength curves devised for the blends formulated from prealloyed aluminum powders were also comparable but quite not to the same extent as green density plots. Experimentally, it was found that the blend that incorporated prealloyed nickel exhibited improved green strength over that containing prealloyed iron. The nominal gain was approximate 800 kPa and occurred at compaction pressures >300 MPa. Similar behaviour can be found noted in powder metal samples of the base powder that included iron and nickel additions as elemental powders. In those sample, nickel additions also imparted a higher green strength than iron.

Interestingly, the green strength data for prealloyed versus elemental means of transition metal addition indicated that the prealloyed samples yielded compacts of a higher strength. The increase was appreciable and amounted to gains on the order of 10-20% depending on the addition and compaction pressure employed.

It is known that commercial P/M alloys such as AC2014 and others exhibit nominal green strengths between 2,500 and 14,000 kPa over a similar range of pressures which are closely comparable to the green strengths that were observed. As these blends are successfully exploited on an industrial scale, the attenuation of comparable green strengths in each of the experimental systems bodes well for any future prospects of industrial usage. Overall, it is worthy to note that neither elemental nor prealloyed additions invoked any deleterious effects on the compaction behavior of the alloy.

Micrographs of green compacts prepared with prealloyed powders were also collected. In those samples containing elemental additions to the base powder metal, no secondary phases were found consistent with the relatively high purity and element segregation. This was in stark contrast to the prealloyed material. In the compacts from the prealloyed powders, a considerable concentration of secondary phases was evident. Those phases were of a fine size and homogenously distributed throughout the aluminum particles.

Looking now at Table I below, data is provided that illustrates the general sintering response of the base powder alone (Al-2.3Cu-1.6Mg-02Sn), prealloyed with 1 wt % iron or nickel, and including 1 wt % iron or nickel as additions as a separate elemental powder.

TABLE I

| Addition | Transition Metal Alloying Method | Sintered Density (g/cc) | Hardness (HRE) |
|---|---|---|---|
| 1 wt % Fe | Prealloyed | 99.20 ± 0.04 | 90.6 ± 0.6 |
| | Elemental | 98.99 ± 0.12 | 84.8 ± 1.5 |
| 1 wt % Ni | Prealloyed | 98.53 ± 0.02 | 85.7 ± 0.5 |
| | Elemental | 98.25 ± 0.15 | 80.1 ± 0 |
| None | N/A | 99.10 ± 0.10 | 83.5 ± 0.7 |

In each instance, the alloy formulated from prealloyed aluminum powder attained a higher sintered density than the elemental counterpart. This was also accompanied by gains in apparent hardness that amounted to 5-6 point improvements on the Rockwell Hardness E scale (HRE).

Several other observations are also notable. For sintered density, the final value attained with 1 wt % iron prealloyed was statistically equivalent to the iron-free sample. This was not the case with prealloyed nickel, as a small but measureable loss in density occurred.

Both elemental powder addition observations were similar to those noted in the first example system above (shown in FIG. 3) in that the samples with 1 wt % iron elemental additions had a benign effect on density whereas 1 wt % nickel elemental additions prompted a reduction in sintered density.

Prealloying the base aluminum powder also yielded sintered products of a higher apparent hardness than the base alloy. The gain was modest with nickel addition (approximately 2 HRE) but more pronounced with iron (approximately 7 HRE).

Tensile properties for the samples prepared from these powder metal formulations are summarized in Table II below.

TABLE II

| Addition | Alloying Method | Yield Strength (MPa) | UTS (MPa) | Ductility (%) |
|---|---|---|---|---|
| 1 wt % Fe | Prealloyed | 178 | 266 | 3.90 |
| | Elemental | 147 | 208 | 4.21 |
| 1 wt % Ni | Prealloyed | 167 | 244 | 4.28 |
| | Elemental | 132 | 197 | 2.82 |
| None | N/A | 158 | 238 | 4.79 |

For each transition metal addition, prealloyed systems drastically outperformed their elemental counterpart. Gains in yield strength and UTS were on the order of 20-30% with a minor loss in ductility for iron, but a significant increase for the case of nickel.

Of the listed powder metal formulation, the best combination of properties was achieved when 1 wt % iron was prealloyed into the base aluminum powder. The tensile attributes of this alloy outpaced those found with prealloyed nickel as well as the base alloy itself. The latter point is of particular significance as it confirms the attenuation of dispersoid strengthening was in fact achieved. As illustrated, prealloyed additions of 1 wt % iron prompted a 12% gain in yield strength and UTS over the unmodified alloy. Ductility was reduced but the final value (approximately 4%) was still significant for a press-and-sinter aluminum powder metal alloy. In fact, the final properties for the dispersoid-strengthened alloy were significantly better than those observed in commercial blends such as AC2014, A6061, and Al-14Si when processed into the same Tl temper.

Furthermore, when an analysis of the sintered microstructure was performed, the more prolific copper absorbing phase of $Al_3(Ni, Cu)_2$ was not detected at any point in the microstructure for the prealloyed nickel powder sample. This observations indicated that the nickel aluminides present through prealloying ultimately scavenged less copper from the alpha-aluminum grains of the microstrucutre. EDS analyses supported this notion given that the nominal copper content was now higher in the alpha-aluminum grains.

When introducing aluminide-type dispersoid phases via elemental powder additions they are inevitably formed in-situ during the sintering process. This involves a progressive series of reactions wherein numerous intermediate phases are possible. Some of these intermediate phases are known to exhibit a pronounced solubility for copper (e.g., $Al_3Ni_2$). These reactions are also exothermic and can invoke in-situ nitridation of the aluminum powder to an extent where it can become a deleterious side reaction. However, in prealloyed powders, aluminides were pre-existing features which eliminated the complications associated with elemental powder additions. This also led to a refined and homogenous distribution of the dispersoid phases in the sintered product. The ability to incorporate these strengthening features (a) without adverse effects on any stage of the press-and sinter production cycle and (b) in a manner that invokes significant strength improvements are viewed as major benefits to the prealloying approach and bode well for eventual implementation on an industrial scale.

Although some formulations have been identified above, it will be appreciated that the transition element-doped aluminum powder may be mixed with additional alloying elements as well, either in the form of prealloyed additions or as elemental powders. Where elemental powder(s) are added, consideration should be made as to whether the elemental powder will degrade sintering performance. For example, the data above indicates that elemental powder additions of iron degrade sintering performance, whereas elemental powder additions of nickel can be made without sacrificing sintering performance. Thus, nickel might be readily added as an elemental powder to the base aluminum alloy, whereas iron might be avoided.

The transition element-doped aluminum powder metal can serve as a base powder that could be used in a variety of alloy systems for improving strength properties and sintering response. In some formulations, this transition element-doped aluminum powder metal could be used in alloy systems with MMCs (metal matrix composites). In these systems, ceramic strengtheners could be added to the transition element-doped aluminum powder metal in amounts of up to 15 volume percent. The ceramic strengtheners that could be added include, but are not limited to, AlN and/or SiC.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A method of making a powder metal part, the method comprising:

forming an aluminum-transition element melt consisting of a 2324 aluminum alloy with additions of transition elements of 1 weight percent iron and 1 weight percent nickel as a total weight percent of the aluminum-transition element melt;

powderizing the aluminum-transition element melt to form a transition element-doped aluminum powder metal; and compacting and sintering the transition element-doped aluminum powder metal to form the powder metal part in which compacting and sintering the transition element-doped aluminum powder metal to form the powder metal part involves separately compacting the transition element-doped aluminum powder metal to form a compact and then subsequently sintering the compact, wherein the sintering consists of heating in a furnace environment to form the powder metal part;

wherein a concentration of the transition elements in the powder metal part is equal to a concentration of the transition elements found in the transition element-doped aluminum powder metal used to form the powder metal part and wherein the concentration of the transition elements in the powder metal part is equal to a concentration of the transition elements found in the aluminum-transition element melt.

2. The method of claim 1, wherein the step of powderizing includes air atomizing the aluminum-transition element melt.

3. The method of claim 1, wherein powderizing the aluminum-transition element melt to form a transition element-doped aluminum powder metal includes at least one of atomizing with a gas, comminution, grinding, chemical reaction, and electrolytic deposition.

4. The method of claim 3, wherein the gas is one of argon, nitrogen, and helium.

5. The method of claim 1, wherein the powder metal part formed from the transition element-doped aluminum powder metal has fewer intermetallics formed along grain boundaries of the part in comparison to a powder metal part made from a powder metal of similar composition but with the transition element added as an elemental powder or as part of a master alloy.

6. A method of making a powder metal part, the method comprising:

forming an aluminum-transition element melt consisting of a 2324 aluminum alloy with additions of transition elements of 1 weight percent iron and 1 weight percent nickel as a total weight percent of the aluminum-transition element melt;

powderizing the aluminum-transition element melt to form a transition element-doped aluminum powder metal in which a concentration of the transition elements in the transition element-doped aluminum powder metal is equal to a concentration of the transition elements found in the aluminum-transition element melt; and compacting and sintering a mixture consisting of the transition element-doped aluminum powder metal and at least one ceramic additive up to 15 volume percent to form the powder metal part in which compacting and sintering the transition element-doped aluminum powder metal and the at least one ceramic additive to form the powder metal part involves compacting the transition element-doped aluminum powder metal and the at least one ceramic additive to form a compact and then subsequently sintering the compact, wherein the sintering consists of heating in a furnace environment to form the powder metal part.

7. A method of making a powder metal part, the method comprising:

forming an aluminum-alloying element melt consisting of a 2324 aluminum alloy with additions of alloying elements of 1 weight percent iron and 1 weight percent nickel as a total weight percent of the aluminum-alloying element melt;

powderizing the aluminum-alloying element melt to form an alloying element-doped aluminum powder metal wherein the alloying elements form an intermetallic phase with the aluminum and wherein the intermetallic phase is homogenously dispersed throughout alloying element-doped aluminum powder metal; and compacting and sintering the alloying element-doped aluminum powder metal to form the powder metal part in which compacting and sintering the alloying element-doped aluminum powder metal to form the powder metal part involves separately compacting the alloying element-doped aluminum powder metal to form a compact and then subsequently sintering the compact, wherein the sintering consists of heating in a furnace environment to form the powder metal part;

wherein a concentration of the alloying elements in the powder metal part is equal to a concentration of the alloying elements found in the alloying element-doped aluminum powder metal used to form the powder metal part and wherein the concentration of the alloying elements in the powder metal part is equal to a concentration of the alloying elements found in the aluminum-alloying element melt.

8. The method of claim 6, wherein at least one ceramic additive is SiC.

9. The method of claim 6, wherein at least one ceramic additive is AlN.

* * * * *